US006330919B1

(12) United States Patent
McGarian

(10) Patent No.: US 6,330,919 B1
(45) Date of Patent: Dec. 18, 2001

(54) METHOD OF REMOVING WELLHEAD ASSEMBLIES AND CUTTING ASSEMBLY FOR USE THEREIN

(75) Inventor: Bruce McGarian, Stonehaven (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/142,467

(22) PCT Filed: Mar. 7, 1997

(86) PCT No.: PCT/GB97/00639

§ 371 Date: May 4, 1999

§ 102(e) Date: May 4, 1999

(87) PCT Pub. No.: WO97/33066

PCT Pub. Date: Sep. 12, 1997

(30) Foreign Application Priority Data

Mar. 8, 1996 (GB) ..... 9604917

(51) Int. Cl.[7] ..... E21B 29/00

(52) U.S. Cl. ..... 166/361; 166/55.7; 166/298

(58) Field of Search ..... 166/55.7, 298, 166/361, 55.6, 55.8, 75.11, 368, 348; 285/18, 363, 364, 368

(56) References Cited

U.S. PATENT DOCUMENTS

| | | | | |
|---|---|---|---|---|
| 3,052,024 | | 4/1962 | Courtney . | |
| 3,308,893 | * | 3/1967 | Wisenbaker et al. | 175/40 |
| 3,330,339 | * | 7/1967 | Johnson | 166/298 X |
| 3,338,305 | * | 8/1967 | Pittman et al. | 166/55.7 X |
| 3,489,211 | * | 1/1970 | Kammerer, Jr. | 166/361 |
| 3,983,936 | * | 10/1976 | Kennard et al. | 166/361 |
| 4,144,936 | | 3/1979 | Evans . | |
| 4,191,255 | * | 3/1980 | Rives | 166/55.7 X |
| 4,389,765 | * | 6/1983 | Thompson, Jr. | 166/55.8 X |
| 4,550,781 | * | 11/1985 | Kagler | 166/55.7 X |
| 4,703,802 | * | 11/1987 | Brytan et al. | 166/55.7 X |
| 4,768,899 | * | 9/1988 | Dysarz | 166/55.7 X |
| 4,844,660 | * | 7/1989 | Ortemond | 166/55.7 X |
| 4,856,938 | * | 8/1989 | Kuehn | 166/55.7 X |
| 4,969,514 | * | 11/1990 | Morris et al. | 166/55.7 X |
| 5,146,989 | * | 9/1992 | Rouse | 166/339 |
| 5,303,776 | * | 4/1994 | Ryan | 166/361 |
| 5,318,115 | | 6/1994 | Rouse . | |
| 5,332,043 | * | 7/1994 | Ferguson | 166/379 |
| 5,404,832 | * | 4/1995 | Hart | 166/96.1 |
| 5,535,827 | * | 7/1996 | Graff et al. | 166/368 |
| 5,848,643 | * | 12/1998 | Carbaugh et al. | 166/85.4 |
| 6,029,745 | * | 2/2000 | Broussard et al. | 166/298 |

FOREIGN PATENT DOCUMENTS

| | | | | |
|---|---|---|---|---|
| 481767 A1 | * | 4/1992 | (EP) | 166/361 |
| 1184480 | | 3/1970 | (GB) . | |
| 2211446 | | 7/1989 | (GB) . | |
| 2 259 930 | | 3/1993 | (GB) . | |

* cited by examiner

*Primary Examiner*—David Bagnell
*Assistant Examiner*—Jong-Suk Lee
(74) *Attorney, Agent, or Firm*—Dykema Gossett PLLC

(57) ABSTRACT

A method of cutting a well casing located beneath a subsea wellhead wherein a cutting assembly is made and lowered into an operative position. A mounting device is secured to the wellhead and the cutter is radially expanded into engagement with the casing. The motor is operated so as to rotate the tubing string and thereby rotate the cutter to cut the casing. A cutting assembly is used to cut a well casing. The cutting assembly has a motor mounting device, a motor, an output shaft, a radially expandable cutter and a tubing string. The tubing string connects the cutter to the output shaft of the motor and clamp members secure the mounting device to the wellhead so that the rotary reaction forces from the mounting device are transmitted to the wellhead. Axial reaction forces are also transmitted from the mounting device to a radially extending surface of the wellhead.

9 Claims, 1 Drawing Sheet

METHOD OF REMOVING WELLHEAD ASSEMBLIES AND CUTTING ASSEMBLY FOR USE THEREIN

BACKGROUND OF THE INVENTION

This invention relates to the removal of wellhead assemblies and, more particularly, to the cutting of well casing below a wellhead to enable removal of the wellhead.

When an oil or gas well is to be abandoned the usual procedure adopted is to plug the well with a suitable cement composition test, the integrity of the plug, and then remove the wellhead assembly. On land, the wellhead assembly can be removed by standard construction techniques and in general the casing immediately below the wellhead will be cut off several meters below ground level to allow reinstatement of the well site. This technique cannot satisfactorily be applied to subsea wells.

It is accordingly known, in the case of a subsea well, to plug the well bore with cement and then to detonate an explosive charge within the well casing slightly below the level of the wellhead proper in order to cut the casing at that point and free the wellhead assembly for removal. This technique is, however, unsatisfactory since the portions of the wellhead removed after explosive cutting are generally damaged and not suitable for re-use.

There is disclosed in EP-A-436706 a technique for cutting and removal of a wellhead by means of a rotating cutting tool mounted at the end of a drill string which is guided through the wellhead by means of a recovery tool. Because this solution requires the use of a drill string it is only applicable to wellheads which are located beneath an appropriate drilling rig. Although, in theory, this method could be applied to a wellhead which is not located beneath a drilling rig to bringing a drilling barge over the wellhead and running the necessary drill string from the drilling barge, such a technique would be prohibitively expensive given the high cost of operating a drilling barge.

SUMMARY OF THE INVENTION

The present invention is according by concerned with a wellhead removal technique which can be used during abandonment of a subsea oil or gas well and which does not require the use of explosive charges or of a drilling rig located above the wellhead.

According to one aspect of the present invention there is provided a method of cutting a well casing located beneath a subsea wellhead, the method comprising the step of running a cutting tool through the wellhead into the casing; securing the position of a motor relative to the wellhead so as to transmit rotary reaction forces from the motor to the wellhead or a fixture secured relative to the wellhead; and operating the motor so as to rotate the cutting tool and thereby effect cutting of the casing.

Because, in the case of the present invention, the reaction force from the motor driving the cutter is reacted on to the wellhead, no rigid coupling from the wellhead to the surface is required. All power required for operation of the cutting tool (including power required by the motor) can be delivered to the wellhead by flexible connections extending from a support vessel located on the surface of the sea close to the wellhead. After the casing has been cut conventional lifting equipment may be used to remove the wellhead assembly.

The invention will be better understood from the following description of a wellhead abandoned operation, particular reference being had to the drawing which shows a casing cutter which may be used in an embodiment of the invention.

The present invention provides a method for recovering the wellhead from a subsea well in a way which does not require the use of explosives nor the presence of a drill string extending from the wellhead to a surface rig. The invention may be practised by use of a Multi-Functional Support Vessel (MSV) which can carry all the equipment and services required to effect abandonment of the well. In the alternative, abandonment may be completed using several vessels, for example one vessel responsible for initial cementing and testing of the well, one vessel for effecting the cutting of the casing, and a third vessel carrying appropriate lifting equipment for removal of the wellhead from the seabed.

In a particular embodiment of the present invention appropriate to abandonment of wellheads in the North Sea, for example in the North East Frig oil field, it is envisaged that all the services required to effect abandonment, save the final lifting of the wellhead assembly, will be completed from a single MSV. Such a vessel can be mobilised with all necessary equipment from a convenient port and can locate the required wellhead by a combination of navigation from Global Positioning System GPS coordinates and sonar scanning. Typically, a submersible vehicle will be used for final wellhead identification and to carry out a survey of the wellhead site prior to commencement of the abandonment operation.

Once on location a bell will be deployed enabling a diver to prepare the well head for the abandonment operation. Such preparation will typically include the removal of a corrosion cap by means of the main MSV crane.

The vessel will then be positioned to allow guidelines to run from the working moonpool to the guideposts of the wellhead.

A subsea wireline lubricator complete with tubing stinger will then be deployed to depth clamping the hydraulic control umbilicals to a pod line when approximately 6 m above the wellhead. The passive compensator will be opened and pressurised to operating tension, under appropriate monitoring. The subsea wireline lubricator will be fully functioned and pressure tested and cement hoses will be run from the MSV by means of a utility crane. Divers will connect hoses to the crossover valves and appropriate cementing operations will be completed. The actual nature of the cementing operation is not critical to the present invention. The object of the cementing operation is to cement the well bore and pressure test the resultant plug to ensure that the well is sealed when the wellhead and the few meters of casing immediately below the wellhead have been completely removed. Once cementing has been completed all cement equipment together with the guidelines can be removed to clear the wellhead. The abandonment operation on the particular wellhead cemented may then be performed. In the alternative, thevessel may complete cementing operations on several wellheads before returning to the first wellhead to continue with the abandonment procedure.

The next stage in the abandonment procedure comprises removal of any seal assembly blocking access to the well bore. The seal assembly may be removed by any conventional technique.

Next, a cutting assembly according to the present invention is deployed. The cutting assembly comprises a mechanical cutter for cutting at least the innermost casing of the well some few (2–3 typically) meters below the wellhead. Typically, such a tool would comprise radially expandable blades which, in use of the tool, are forced radially outwardly into engagement by the casing by means of hydraulic pressure. A typical embodiment of cutting apparatus, deployed on a wellhead, is shown in the drawing. The actual casing cutter reference number 22 will, in practice, be located at the lower end of the tubing string 8. The exact design of cutter is not critical to the present invention and any appropriate design of rotary cutter having expandable cutters for cutting well casing etc may be used.

BRIEF DESCRIPTION OF THE DRAWINGS

The FIGURE is a cross-sectional view of the present invention.

DESCRIPTION OF THE PREFERRED EMBODIMENT

Figure 1:
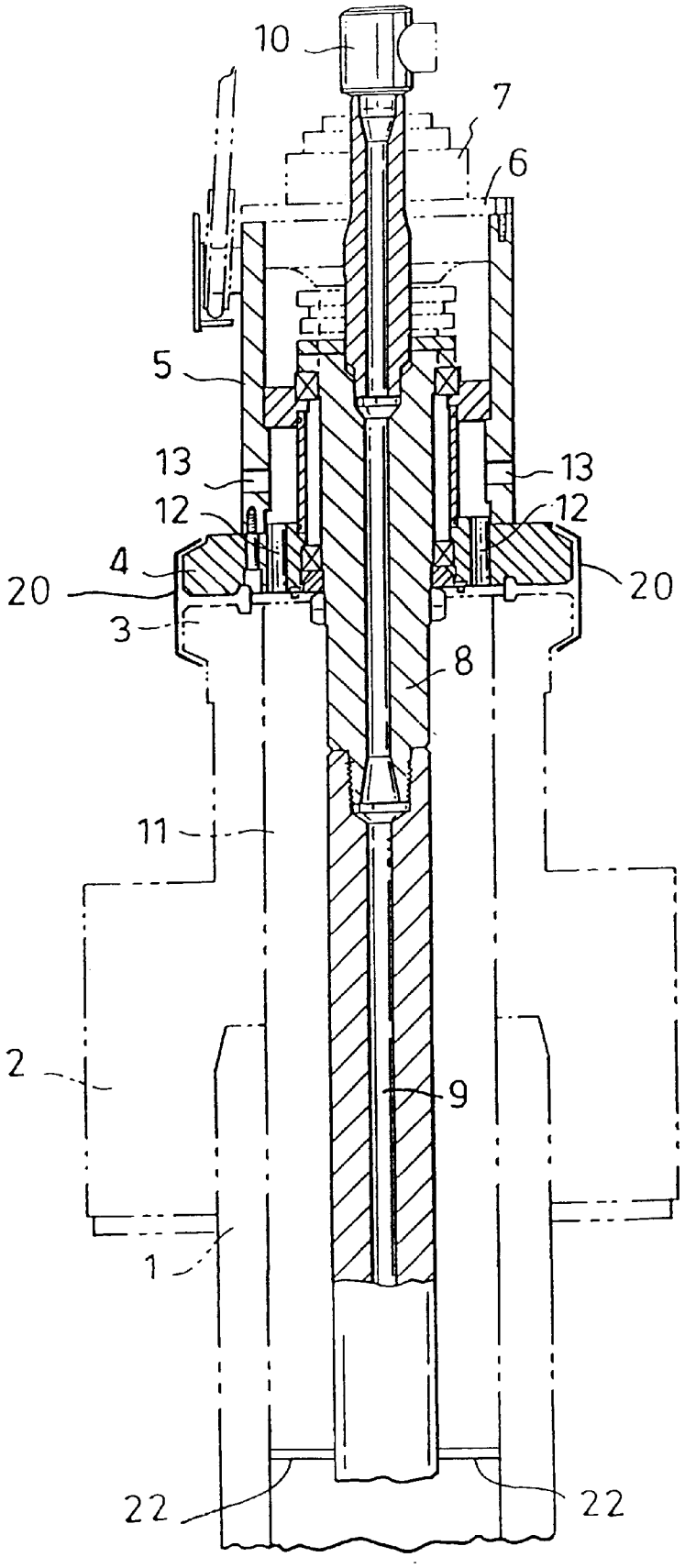

The wellhead 1 is shown schematically in FIG. 1. The exact configuration of the wellhead is not critical, and the present invention may be operated for a wide range of commercially available wellhead profiles. In order to mount the present invention atop the wellhead, a suitable wellhead connector 2 is mounted atop and secured to the wellhead by conventional means. As illustrated, the wellhead connector 2 is an ABB Vetco Grey type H4 connector.

The mounting of the wellhead connector 2 onto the wellhead 1 prevents rotation of the connector 2 relative to the wellhead. Accordingly, torque applied to the connector 2 will be transmitted to the wellhead and from the wellhead to the casing or a guide base. Furthermore, torque arms may be used which extend from the connector 2 or another part of the cutting assembly to the guideposts or other suitable fixtures.

The upper end of the wellhead connector 2 terminates in a connection flange 3 to which is secured a mounting flange 4 of a mounting device 5. The flanges 3, 4 may be secured together by any appropriate means, for example by bolts, studs or clamps. In the illustrated embodiment of the invention the flange 4 is an API specification hub and is clamped to the flange 3 by appropriate clamp members 20.

The mounting device 5 includes a top plate 6 to which is secured a hydraulic motor 7. The hydraulic motor is provided for the purpose of rotating a short string 8 to the lower end of which is connected an appropriate casing cutter. The exact design of the cutter is not relevant to the present invention. The cutter is of a type which includes radially expandable cutting elements which, in use, are driven radially outwardly into engagement with the casing by hydraulic pressure applied via the central bore 9 of the string. Hydraulic pressure, for example pressurised water, is applied to the bore 9 via a rotary union 10. Preferably, water from the bore 9 is used to cool the cutting blades of the cutting device and to flush debris away from the blades. Water and debris exiting the cutting tool will flow upwardly via the annulus 11 between the string 9 and the casing and will pass through bores 12 provided in the flange 4 and then radially outwardly through passages 13 provided in the body of the mounting device 5.

The motor 7 can be of any convenient type, for example it may be a hydraulic motor operated by hydraulic power supplied from the MSV.

Because the motor 7 is mounted on the plate 6 which forms part of the mounting device 5 which is itself secured to the flange 3, reaction force generated on the body of the motor 7 during rotation of the string 8 will be applied to the connector 2 and then to the wellhead 1. Accordingly, connections to the assembly illustrated in the drawing may be made entirely by flexible connections, and no member extending from the surface to the wellhead need react any torque forces generated during the cutting operation.

Depending on the exact nature of the cutter provided, and depending on the number and diameter of the casings located in the cutting zone, it may be necessary to remove the cutting tool periodically and reconfigure it to cut progressively larger diameters. When such reconfiguring takes place the cutting elements of the cutting tool may also be replaced if worn. Recovery of the cutting assembly for the purpose of changing the cutting elements or reconfiguring the cutting arrangement can readily be effected by releasing the flange 3 from the flange 4 and withdrawing the entire assembly to surface. Guidelines may be used to assist re-deployment of the assembly.

On completion of the cutting of the casing a mechanical cutting system may be used to cut the four 30" piles.

As the multi string cutting operation proceeds the completed wellhead may be surveyed to confirm full severance for casing strings. This can be achieved using a remote video camera to carry out internal surveys of the mechanical cut, a mechanical survey tool, or an appropriate logging tool. Once full cutting of the casing and piles have been completed the wellhead may be removed. If the wellhead can be broken free from the ocean floor relatively easily recovery may be affected using the MSV main crane. In the alternative, the MSV may be cleared from the site and a heavy lifting barge deployed to apply the necessary vertical lift to the wellhead assembly.

It should be noted that as an alternative to the fixed motor described above an appropriate mud motor may be incorporated in the drill string. In this case, the rotational force generated by the mud motor will again be reacted onto the wellhead via a mounting device so that the requirement for a rotation resisting drill string extending from the wellhead to the surface will be removed.

As compared with the prior art, the invention offers a number of significant advantages as will be appreciated by those skilled in the art. One particular advantage of the present invention is that the overall assembly can be manufactured in a relatively compact manner so that the distance from the top of the wellhead to the cutter is relatively small. This will enable severance of the casing closer to the wellhead and assist in subsequent removal of the wellhead assembly.

What is claimed is:

1. A method of cutting a well casing located beneath a subsea wellhead, the method comprising the steps of:

making up a cutting assembly by securing a body of a motor to a motor mounting device and connecting a radially expandable cutter to an output shaft of the motor by means of a tubing string;

lowering the cutting assembly into an operative position in which the cutter is located in the casing below the wellhead and the mounting device is located at or above the level of the wellhead and adjacent a surface of a fixture secured adjacent the wellhead, said surface extending radially of the longitudinal axis of the tubing string;

securing the mounting device to the fixture so as to transmit rotary reaction forces from the mounting device to the fixture and to transmit axial reaction forces from the mounting device to said surface;

radially expanding the cutter into engagement with the casing; and operating the motor to rotate the tubing string and thereby rotate the cutter to cut the casing.

2. A method of cutting a well casing according to claim 1, further including the step of securing the fixture to the wellhead prior to the step of lowering the cutting assembly into its operative position, wherein the fixture is a wellhead connector mounted on the wellhead.

3. A method of cutting a well casing according to claim 2, wherein the step of securing the mounting device comprises clamping the mounting device to the wellhead connector.

4. A method of cutting a well casing according to claim 1, wherein the step of radially expanding the cutter is effected by supplying pressurized fluid to the cutter via the tubing string.

5. A method of cutting a well casing according to claim 4, wherein the pressurized fluid is pressurized mud or pressurized water.

6. A method of cutting a well casing as claimed in claim 4, including the additional step of connecting the motor to a supply of pressurized fluid with a flexible connection.

7. A method of cutting a well casing as claimed in claim 6, wherein the pressurized fluid is supplied from a support vessel.

8. A method of cutting a well casing as claimed in claim 1, wherein the step of operating the motor includes supplying the motor with hydraulic power.

9. A method of cutting a well casing as claimed in claim 1, wherein further steps are undertaken following the step of operating the motor, the further steps comprising:

(a) ceasing the operation of the motor;

(b) removing the cutting assembly from the casing and the wellhead;

(c) reconfiguring the cutter to cut an alternative well casing diameter and/or replacing worn cutting elements;

(d) replacing the cutting assembly in its operative position; and (e) continuing the operation of the motor.

* * * * *